US005926916A

United States Patent [19]

Lee et al.

[11] Patent Number: 5,926,916

[45] Date of Patent: Jul. 27, 1999

[54] COMPUTER HOUSING HAVING A DOOR WHICH CAN BE OPENED/CLOSED FROM EITHER SIDE

[75] Inventors: Seung-Woon Lee; Tae-Sang Kim, both of Suwon-si, Rep. of Korea

[73] Assignee: SamSung Electronics Co., Ltd., Kyungki-do, Rep. of Korea

[21] Appl. No.: 08/839,137

[22] Filed: Apr. 23, 1997

[30] Foreign Application Priority Data

Apr. 23, 1996 [KR] Rep. of Korea ..... 96-12345
Aug. 22, 1996 [KR] Rep. of Korea ..... 96-34893

[51] Int. Cl.[6] ..... E05D 15/50

[52] U.S. Cl. ..... 16/230; 312/324; 49/193; 16/232; 361/724

[58] Field of Search ..... 16/231, 232, 229, 16/230; 49/193, 382; 312/223.2, 324; 361/683, 724

[56] References Cited

U.S. PATENT DOCUMENTS 3,654,663 4/1972 Algotsson ..... 16/230
4,811,518 3/1989 Ladisa ..... 49/193
5,187,836 2/1993 Kim et al. ..... 16/231
5,717,570 2/1998 Kikinis ..... 312/223.2

FOREIGN PATENT DOCUMENTS 54-146439 11/1979 Japan ..... 16/232
54-155638 12/1979 Japan ..... 49/193
3-286082 12/1991 Japan ..... 16/232
4-41883 2/1992 Japan ..... 49/193

*Primary Examiner*—Chuck Y. Mah
*Assistant Examiner*—Donald M. Gurley
*Attorney, Agent, or Firm*—Robert E. Bushnell, Esq.

[57] ABSTRACT

This invention relates to a computer having a door being opened/closed at either side having a case for protecting internal circuits of a computer from an external impact, a face which is attached to the front of the case; and a door, installed in an open area of the face, which can be opened/closed from either side.

8 Claims, 8 Drawing Sheets

COMPUTER HOUSING HAVING A DOOR WHICH CAN BE OPENED/CLOSED FROM EITHER SIDE

CLAIM OF PRIORITY

This application makes reference to, incorporates the same herein, and claims all benefits accruing under 35 U.S.C §119 from an application entitled A Computer Having A Door Being Opened/Closed At Either Side earlier filed in the Korean Industrial Property Office on Apr. 23, 1996 and Aug. 22, 1996, and there duly assigned Ser. No. 96-12345 and 96-34893, respectively, by that Office.

BACKGROUND OF THE INVENTION

1. Field of the Invention

The present invention relates to a computer housing having a door being opened/closed at either side, more particularly, to the computer housing having the door which is conveniently used irrespective of peripheral devices by being opened/closed in an optional direction in a desktop computer.

2. Description of the Prior Art

A computer housing having a conventional door is explained with reference to the accompanying drawings.

FIG. 12 is a perspective view of a conventional computer having a unidirectional door for closing off access to the various disk drives. As shown in FIG. 12, the conventional computer having the door includes a case 10 for protecting the internal components of the computer, a face 40 which is attached to the front side of the case 10 and has a plurality of catch grooves 20 and pivot holes 30, and a unidirectional door 50, which is hinged to face 40, for protecting auxiliary storage devices, e.g., disk drives and a CD-ROM drive, from, for example, an external impact.

Unidirectional door 50 includes pivots 60 which project from unidirectional door 50 and into hinge holes 30 of face 40 for rotatably connecting unidirectional door 50 with face 40, and a catches 70 which are elastically formed on the unidirectional door 50 removably connect to catch grooves 20 of face 40.

The above prior art protects an auxiliary storage device from an external impact by using a unidirectional door, however, since the door can only be opened from one (the left side shown in FIG. 12) side placement of the computer in a work station or on a desk or placement of peripheral devices is is limited because the door is opened in only one direction.

SUMMARY OF THE INVENTION

It is an object of the present invention to provide a computer housing having a bidirectional door whose opening from either side and thus is not restricted by the placement of the computer nor by other devices.

To achieve the above object, the present invention utilizes a case for protecting internal components of a computer, a face which is attached to the front of the case, and a door which is pivotally mounted on the face so that the door can be opened/closed from either the left or right side of the door.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

A preferred embodiment of the present invention will become apparent from a study of the following detailed description with reference to the accompanying drawings.

Figure 1:
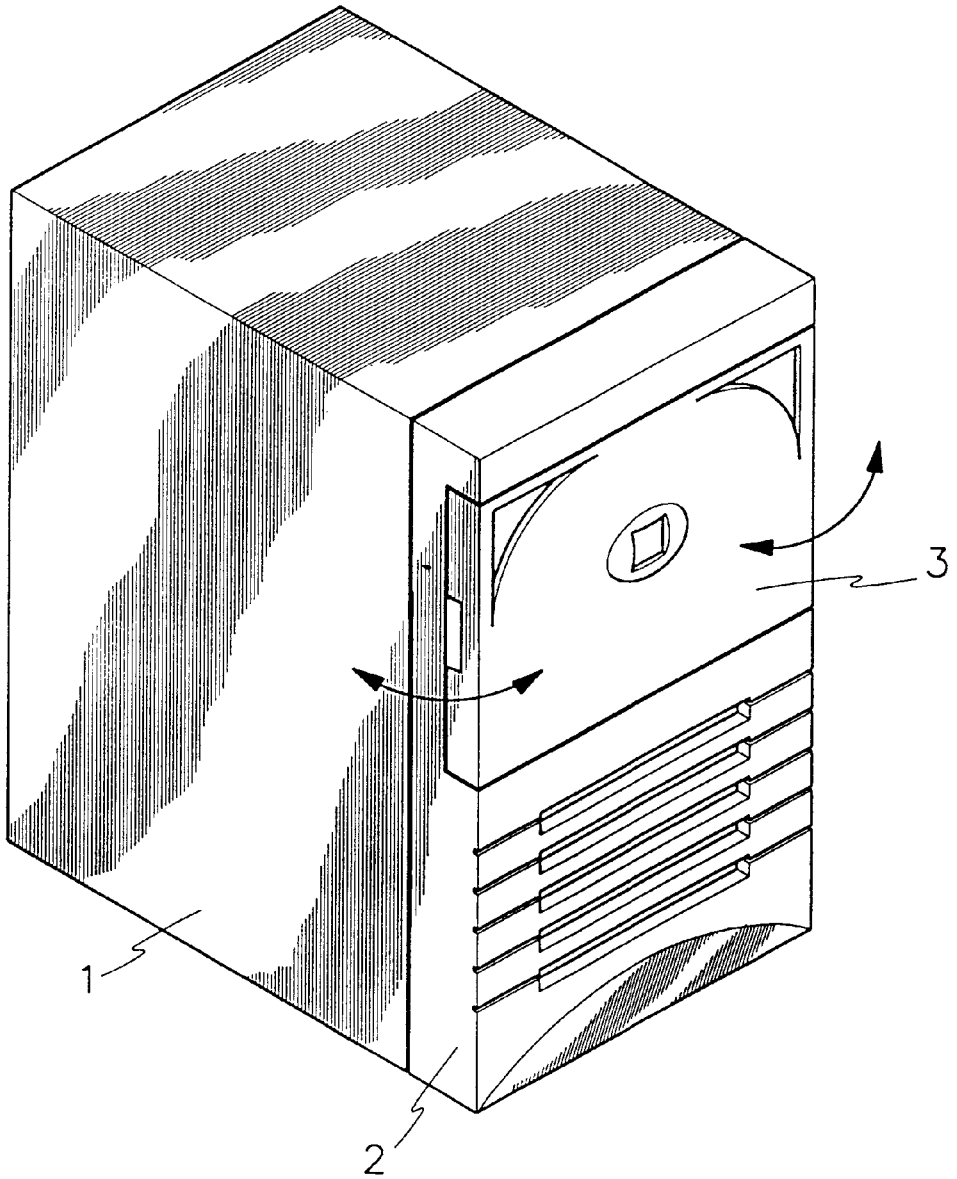
FIG. 1 is a perspective view showing the closed state of a bidirectional door in accordance with a first embodiment of the present invention.

As shown in FIG. 1 the computer housing has a case 1, a face 2 and a door 3 which is installed in an open area of face 2 so that it can be opened/closed from either the left or right either side (as illustrated by the double headed arrows).

Figure 2:
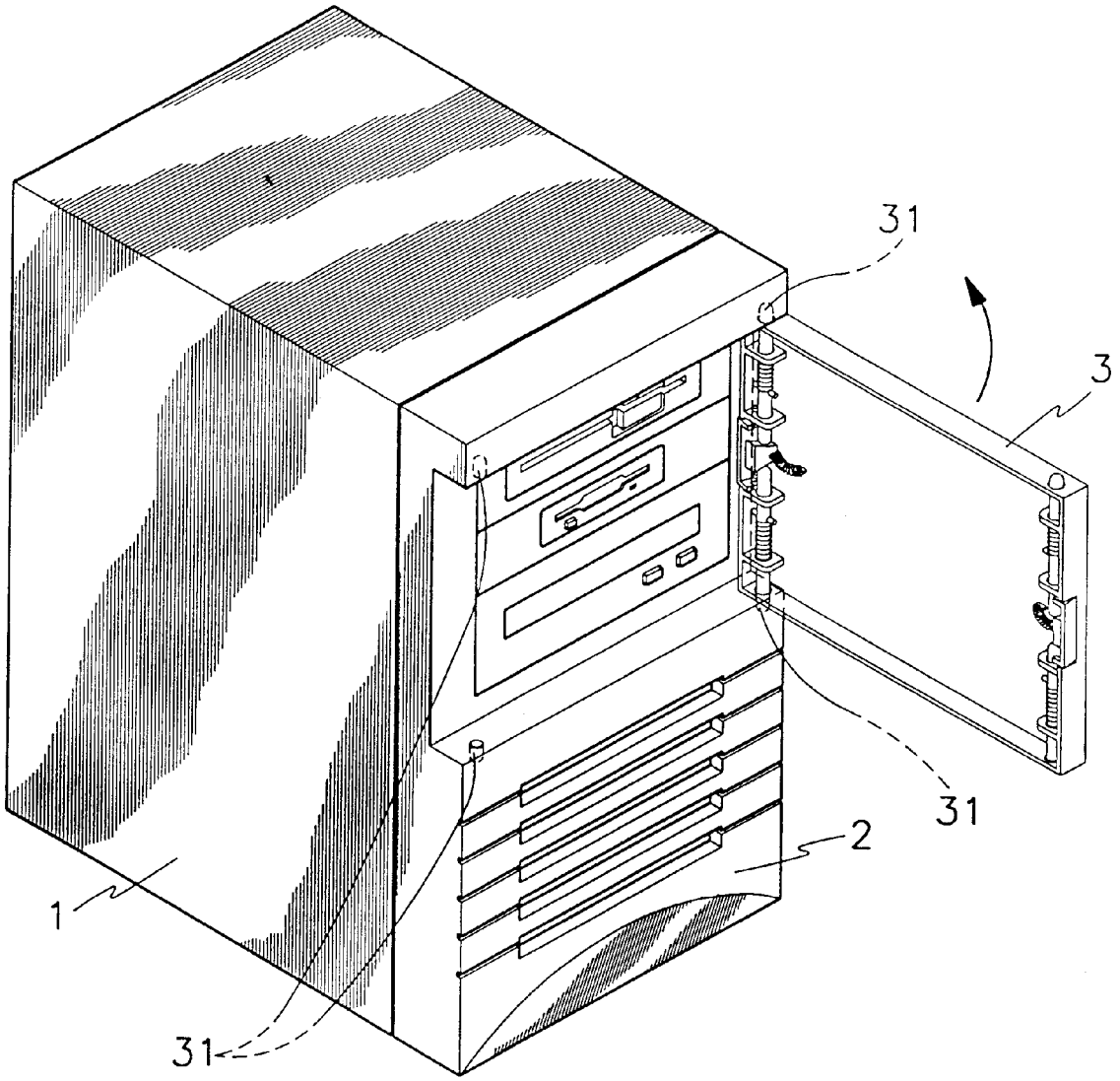
FIG. 2 is a perspective view showing the opened state of the bidirectional door being opened from the left side and pivotally mounted to the face on the right side in accordance with the first embodiment of the present invention.
Figure 3:
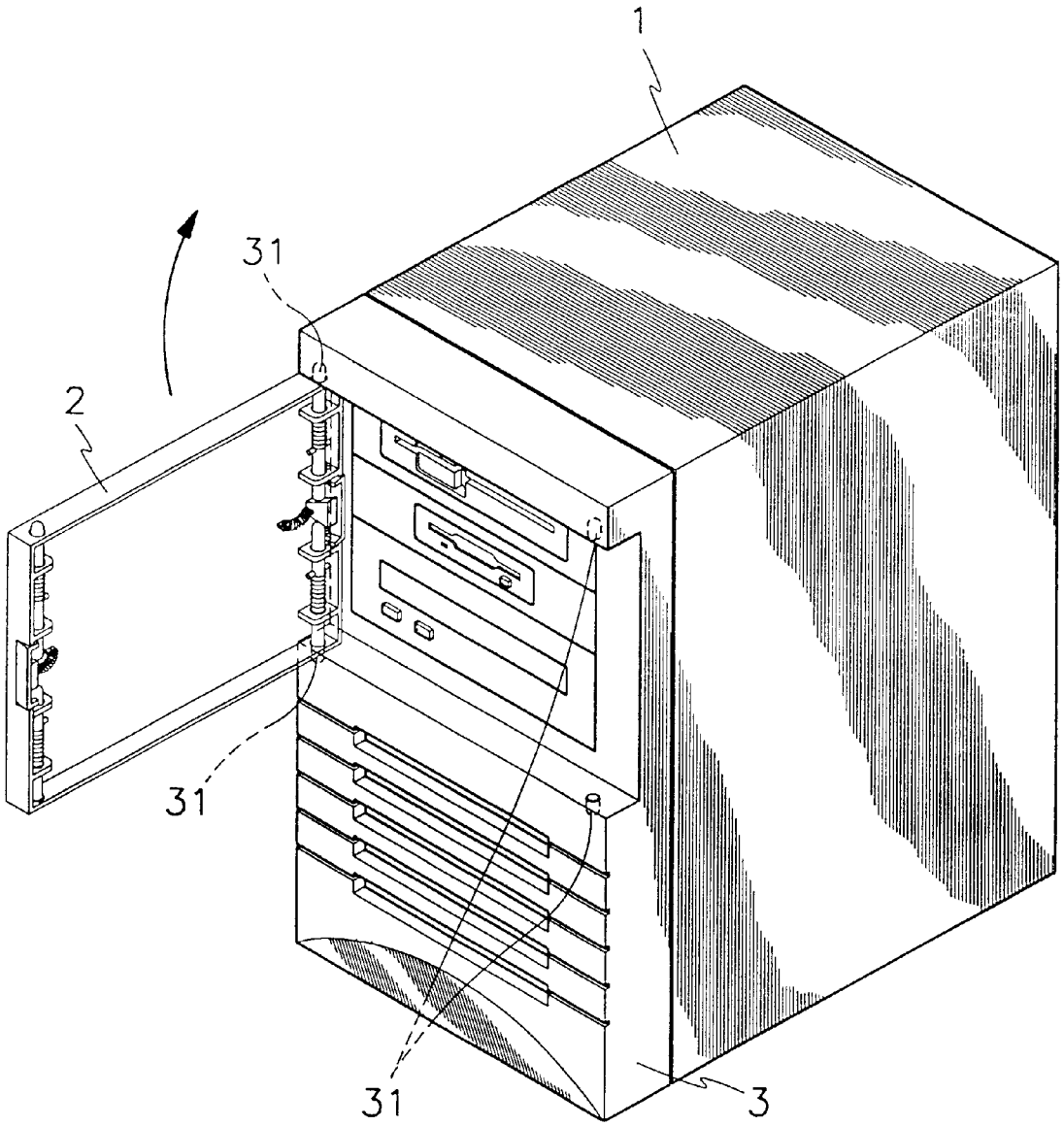
FIG. 3 is a perspective view showing the opened state of the bidirectional door being opened from the right side and pivotally mounted to the face on the left side in accordance with the first embodiment of the present invention.

FIG. 2 is a perspective view showing the opened state of bidirectional door 3 being opened from the left side and pivotally mounted on the right side to catch grooves 31 in face 2. FIG. 3 is a perspective view showing the opened state of bidirectional door 3 being opened from the right side and pivotally mounted on the left side to catch grooves 31 in face 2. Accordingly, face 2 has four catch grooves 31 adjacent the open area of face 2.

Figure 4:
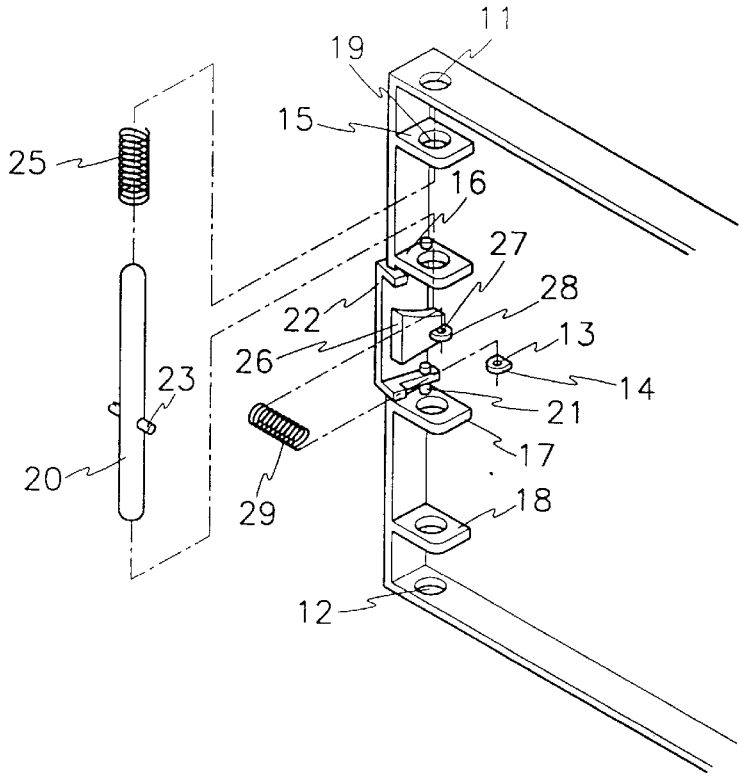
FIG. 4 is an exploded perspective view of the latching hinge and one side of the bidirectional door in accordance with the first embodiment of the present invention.

FIG. 4 is an exploded perspective view of the latching hinge and one side of bidirectional door 3, however, the other side of door 3 includes the same combination of elements forming the latching hinge and door combination shown in FIG. 4. And, FIG. 5 is an assembled view of the latching hinges and door 3.

Figure 5:
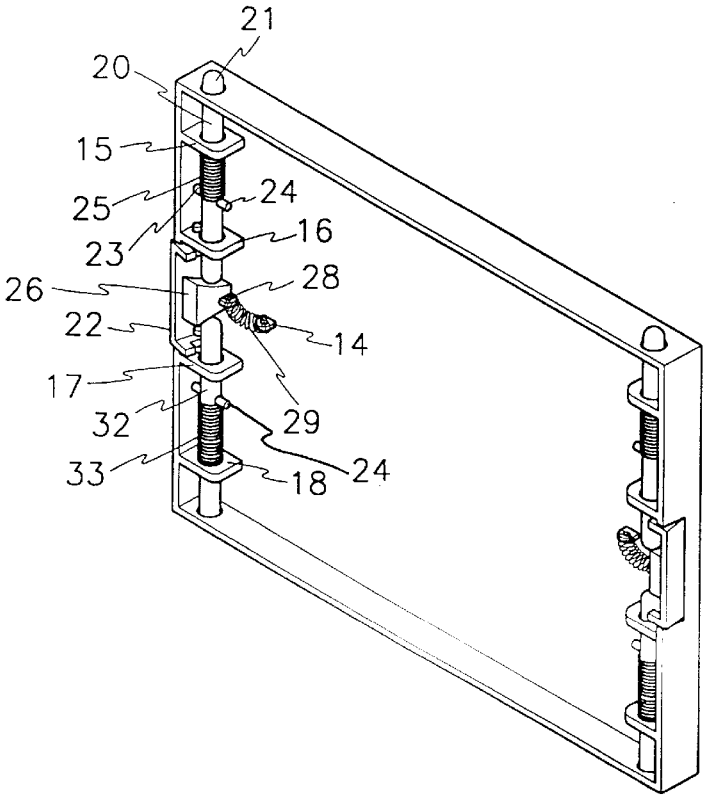
FIG. 5 is an assembled view of the latching hinges and the bidirectional door in accordance with the first embodiment of the present invention.

Referring now to FIGS. 4 and 5, door 3 has a pair of hinge pin holes 11 and 12 through the upper and lower side walls of the door. The left side wall of door 3 has a plurality of tabs 15, 16, 17 and 18 extending horizontally therefrom, and each tab has a hinge pin hole 19 therein which is centrally aligned with holes 11 and 12. Note that tabs 15–18 can extend from the rear portion of door 3 or may be attached to both the rear portion and the side wall of door 3. The left (and right) side wall of door 3 has an open space in which a lever 22 is centrally positioned and rotatably attached via pins 21 to tabs 16 and 17. A wedge shaped cam 26 is attached to the back side of lever 22 and a spring holder 28 extends horizontally from cam 26. Spring holder 28 has a catch hole 27 therein to which a first end of a return spring 29 is connected. A spring holder 14 horizontally extends from the back side of door 3 and has catch hole 13 to which a second end of return spring 29 is connected.

Each side of door 3 incorporates an upper and lower latching hinge. The upper latching hinge incorporates a hinge pin 20 extending through holes 19 in tabs 15 and 16, wherein one end of hinge pin 20 is in constant contact with cam 26 and the other end 21 of hinge pin 20 extends through hole 11 until lever 22 is manipulated to open door 3, at which time end 21 of hinge pin 20 passes downward into hole 11 so that no portion of hinge pin 20 extends above the upper side wall of door 3. A stop pin 23 passed through hinge pin 20 and hinge pin 20 passes through a spring 25 positioned between stop pin 23 and tab 15.

The lower latching hinge incorporates a hinge pin 32 extending through holes 19 in tabs 17 and 18, wherein one end of hinge pin 32 is in constant contact with cam 26 and the other end of hinge pin 32 extends through hole 12 until lever 22 is manipulated to open door 3, at which time the end of hinge pin 32 passes downward into hole 12 so that no portion of hinge pin 32 extends below the lower side wall of door 3. A stop pin 24 passed through hinge pin 32 and hinge pin 32 passes through a spring 33 positioned between stop pin 24 and tab 18.

Figure 6:
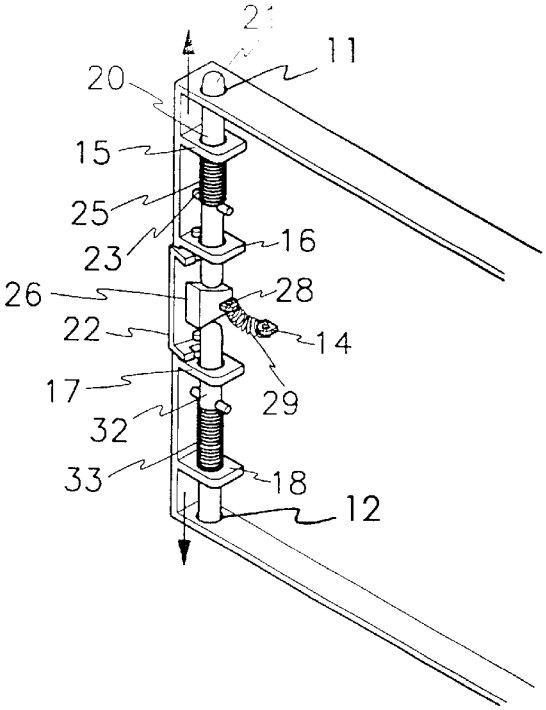
FIG. 6 is a state view showing the hinging and latching functions of the latching hinge on one side of the bidirectional door in accordance with the first embodiment of the present invention.
Figure 7:
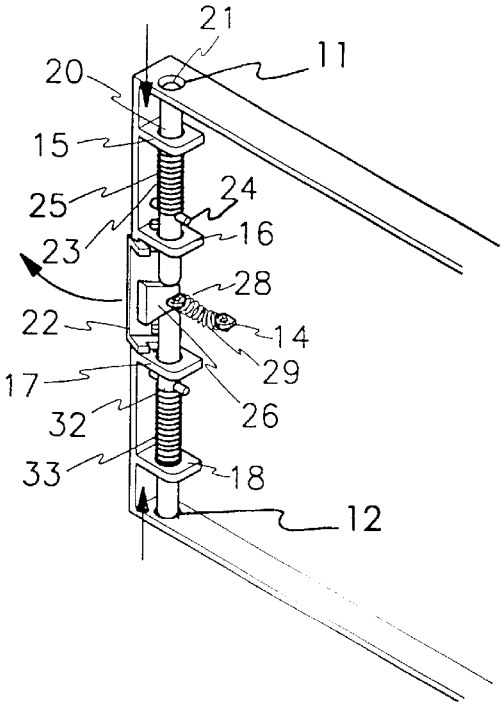
FIG. 7 is a state view showing the releasing function of the latching hinge on one side of the bidirectional door in accordance with the first embodiment of the present invention.

The operation of the latching hinge will now be explained with reference to FIGS. 6 and 7. As shown in FIG. 6, lever 22 is in a closed position and ends 21 of hinge pins 20 and 32 extend through holes 11 and 12 in the upper and lower side walls of door 3. When lever 22 is rotated to the open position (as depicted by the arrow adjacent lever 22 in FIG. 7), springs 25 and 33 bias hinge pins 20 and 32 downward and upward, respectively, thereby causing one end of each of hinge pins 20 and 32 to remain in contact and follow the curved surfaces of cam 26. Accordingly, end 21 of hinge pin 20 descends into hole 11, while simultaneously end 21 of hinge pin 32 ascends into hole 12.

When lever 22 is released, return spring 29 biases lever 22 into its closed position, shown in FIG. 6, and hinge pins 20 and 32 move upward and downward, respectively, thereby causing end 21 of hinge pin 20 to ascend through hole 11, while simultaneously causing end 21 of hinge pin 32 to descend through hole 12.

According to the first embodiment described above, bidirectional door 3 can be opened from either the left or right side while the latching hinge on the side remaining closed performs a hinging operation thereby allowing a user to position the computer where desired. Also, the door can be removed from face 2 by manipulating the levers on both sides of the door.

Figure 8:
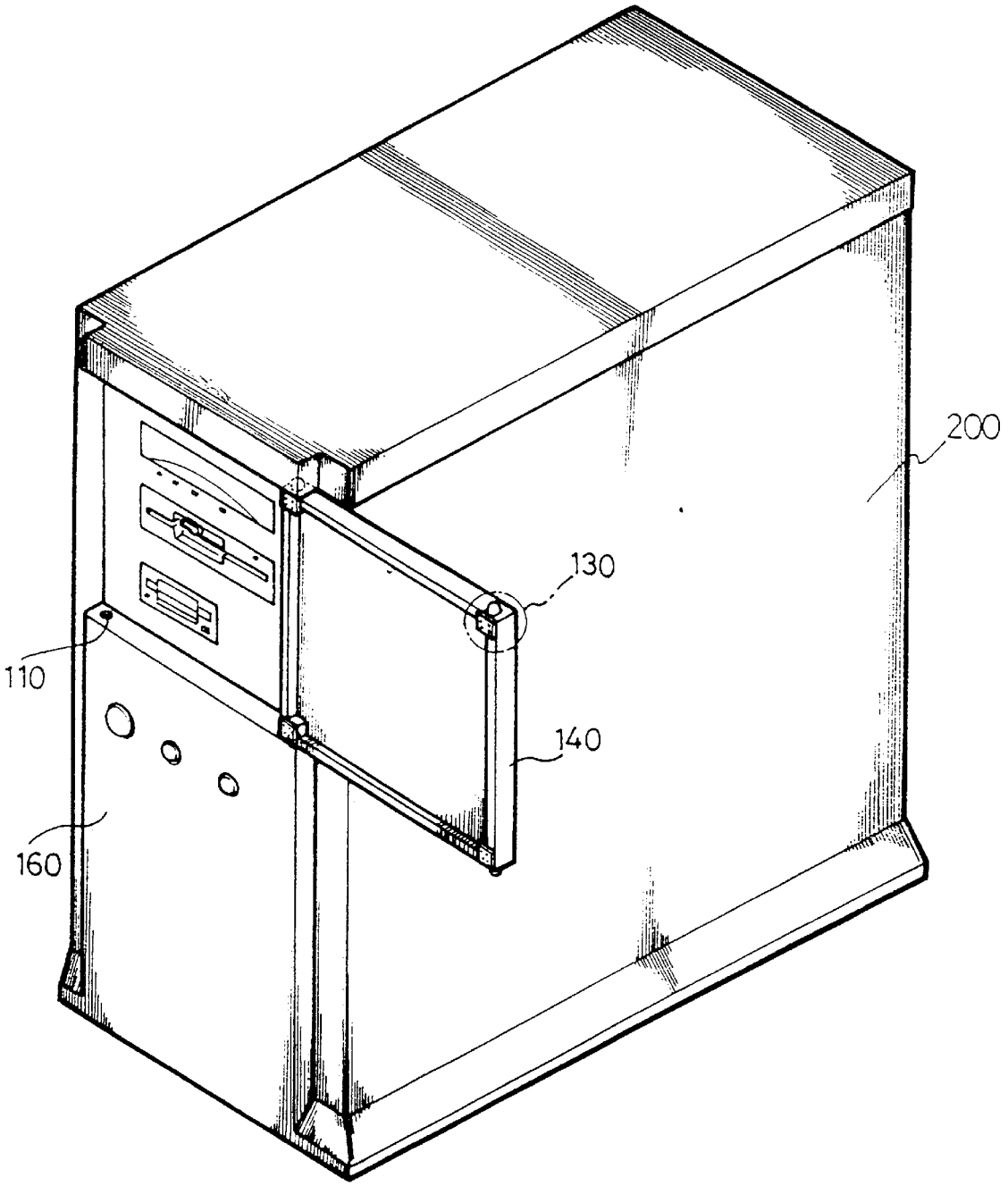
FIG. 8 is a perspective view showing a computer having a bidirectional door in accordance with a second embodiment of the present invention.

Next, a second embodiment of the bidirectional door will be explained with respect to FIGS. 8–11. As shown in FIG. 8, a computer having a bidirectional door in accordance with the second embodiment of the present invention has a case 200 for protecting the internal elements of the computer, a face 160 which is attached to the front of case 200, and a bidirectional door 140 which protects the computer's auxiliary storage devices. Door 140 includes a catch hinge 130 in each of its four corners.

Figure 9:
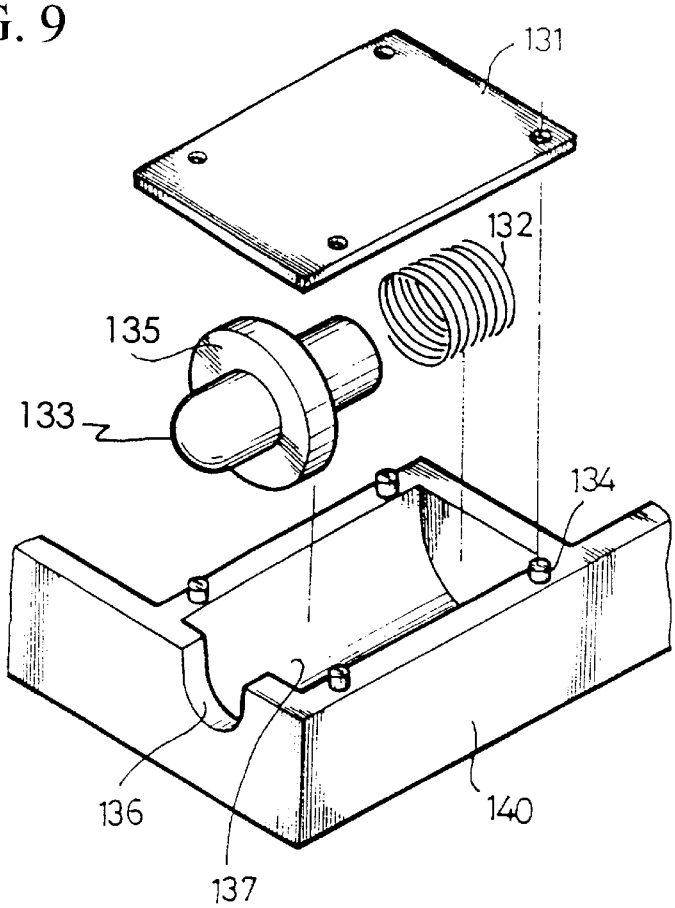
FIG. 9 is an exploded perspective view of one of the latching hinges of the bidirectional door shown in FIG. 8 in accordance with the second embodiment of the present invention.

FIG. 9 is an exploded perspective view of one of the catching hinges of the bidirectional door shown in FIG. 8, wherein catch hinge 130 includes a pocket 137 formed in door 140, a groove 136 formed in an upper (or lower) side wall of door 140, a plurality of cylindrical protrusions 134 extending horizontally from door 140 along the perimeter of pocket 137, a catch pin 133 having a fixed collar 135, a spring positioned over catch pin 133 between collar 135 and an end wall of pocket 137, and a fixing plate 131 having a plurality of holes corresponding to protrusions 134 so that fixing plate 131 will enclose catch pin 133, collar 135 and spring 132 in pocket 137.

Figure 10:
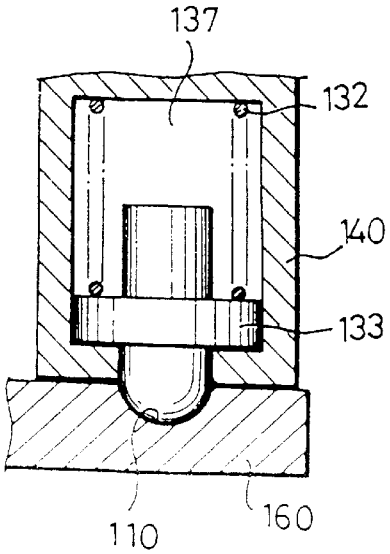
FIG. 10 shows an engaged condition of the latching hinge of the bidirectional door and the face of the computer cover in accordance with the second embodiment of the present invention.
Figure 11:
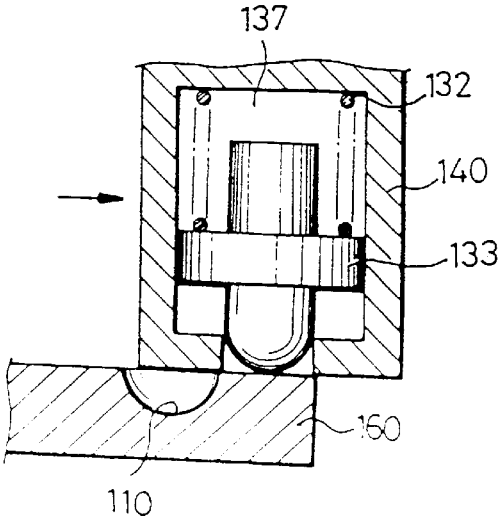
FIG. 11 shows an released/opened condition of the latching hinge of the bidirectional door and the face of the computer cover in accordance with the second embodiment of the present invention.
Figure 12:
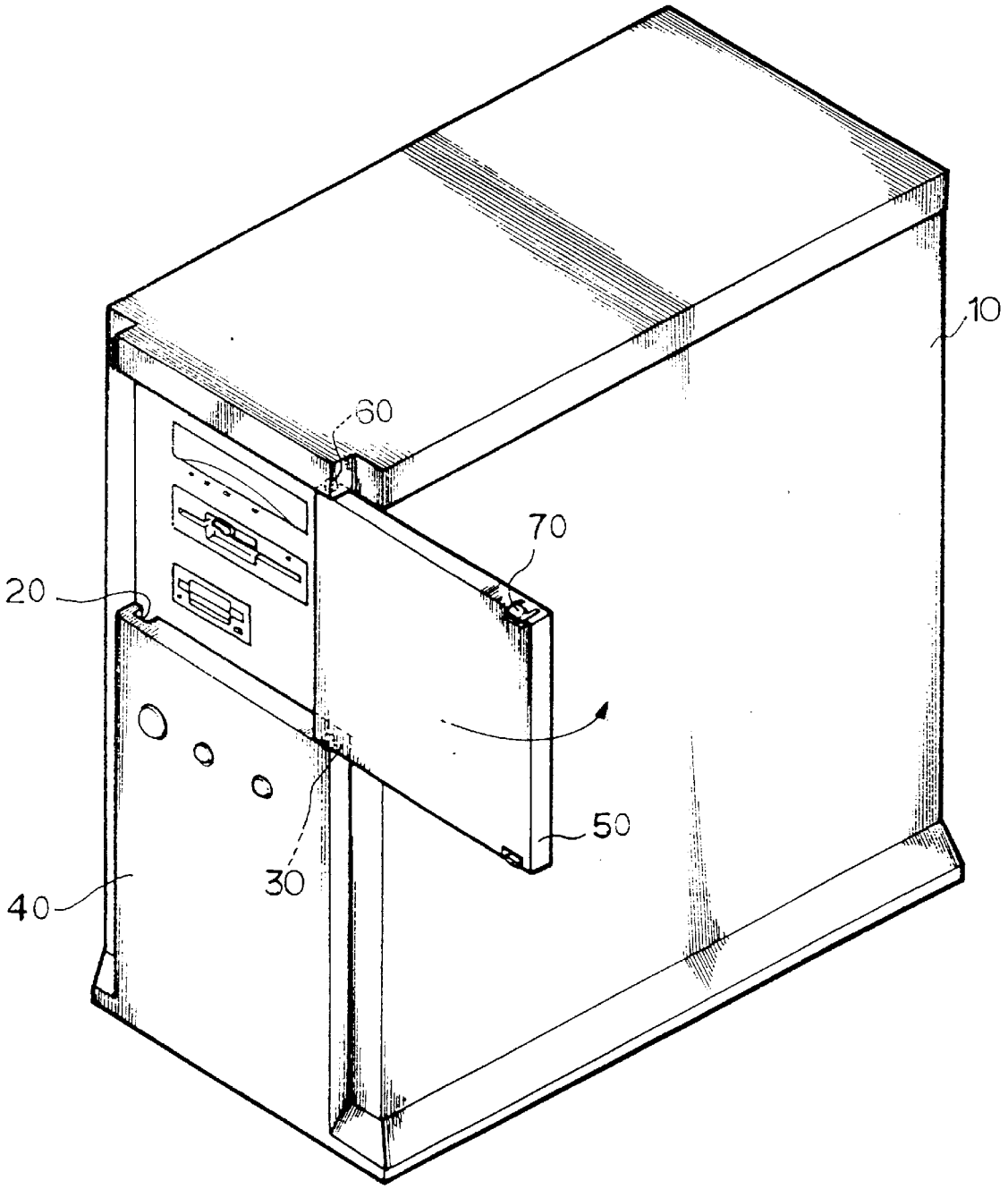
FIG. 12 (PRIOR ART)
FIG. 12 is a perspective view of a conventional computer having a unidirectional door.

As shown in FIG. 10, catch hinge 130 of bidirectional door 140 is engaged with face 160. Face 160 includes a detent 110 which accepts the rounded end of catch pin 133.

When a side of door 140 is pushed or pulled to open the door, the rounded end of hinge pin 133 ride up the sloping portion of detent 110 thereby compressing spring 132 until the rounded end of catch pin 133 no longer extends past the side wall of door 140 thus allowing door 140 to be opened.

According to the second embodiment described above, bidirectional door 140 can be opened from either the left or right side while catch hinges 130 on the side remaining closed performs a hinging operation thereby allowing a user to position the computer where desired. Also, the door can be removed from face 160 by pulling on both sides of the door at the same time.

While the present invention has been described with reference to a few specific embodiments, the description is illustrative of the invention and is not to be constructed as limiting the invention. Various modifications may occur to those skilled in the art without departing from the true spirit and scope of the invention as defined by the appended claims.

What is claimed is:

1. A computer housing, comprising:

a case for protecting internal elements of a computer from an external impact;

a face having an open area therein, said face being attached to a front portion of said case, wherein said face comprises a plurality of catch grooves respectively formed in each of four corners of said open area; and a bidirectional door installed in said open area of said face, said bidirectional door being opened/closed from both a left side and a right side of said bidirectional door, wherein said bidirectional door comprises left, right, upper and lower side walls, and further comprises:

first and second spring holders attached to a rear side of said bidirectional door, wherein said first and second spring holders each have a catch hole therethrough;

a plurality of hinge pin holes in said upper and lower side walls, wherein each of said plurality of hinge pin holes align with a respective one of said plurality of catch grooves when said bidirectional door is closed;

a plurality of tabs extending horizontally from said left and right side walls of said bidirectional door, wherein each of said tabs have a hinge pin hole therethrough;

first and second levers respectively positioned within an open space in said left and right side walls and rotatably attached to a central pair of said tabs extending horizontally from said left and right side walls of said bidirectional door, said first and second levers each being rotatable between an open position and a closed position;

first and second cams respectively attached to said first and second levers;

third and fourth spring holders respectively attached to said first and second cams;

a first return spring connected between said first and third spring holders for biasing said first lever in said closed position;

a second return spring connected between said second and fourth spring holders for biasing said second lever in said closed position;

a first hinge pin having a first end extending through a first one of said hinge pin holes in said upper side wall and into a first one of said catch grooves, and a second end in contact with a first surface portion of said first cam;

a second hinge pin having a first end extending through a second one of said hinge pin holes in said upper side wall and into a second one of said catch grooves, and a second end in contact with a first surface portion of said second cam;

a third hinge pin having a first end extending through a first one of said hinge pin holes in said lower side wall and into a third one of said catch grooves, and a second end in contact with a second surface portion of said first cam;

a fourth hinge pin having a first end extending through a second one of said hinge pin holes in said lower side wall and into a fourth one of said catch grooves, and a second end in contact with a second surface portion of said second cam;

a first stop pin diametrically extending through said first hinge pin;

a second stop pin diametrically extending through said second hinge pin;

a third stop pin diametrically extending through said third hinge pin;

a fourth stop pin diametrically extending through said fourth hinge pin;

a first spring positioned over said first hinge pin and in contact with said first stop pin and one of said tabs extending horizontally from said left side wall for biasing said first hinge pin downward;

a second spring positioned over said second hinge pin and in contact with said second stop pin and one of said tabs extending horizontally from said right side wall for biasing said second hinge pin downward;

a third spring positioned over said third hinge pin and in contact with said third stop pin and another one of said tabs extending horizontally from said left side wall for biasing said third hinge pin upward; and a fourth spring positioned over said fourth hinge pin and in contact with said fourth stop pin and another one of said tabs extending horizontally from said right side wall for biasing said fourth hinge pin upward.

2. The computer housing as set forth in claim 1, wherein said first and second surface portions of said first cam are curved for enabling said first hinge pin to be biased downward by said first spring such that said first end of said first hinge pin descends through said first one of said hinge pin holes in said upper side wall and for enabling said third hinge pin to be biased upward by said third spring such that said first end of said third hinge pin ascends through said first one of said hinge pin holes on said lower side wall, when said first lever is moved to said open position, thereby enabling said left side of said bidirectional door to be opened or closed.

3. The computer housing as set forth in claim 1, wherein said first and second surface portions of said second cam are curved for enabling said second hinge pin to be biased downward by said second spring such that said first end of said second hinge pin descends through said second one of said hinge pin holes in said upper side wall and for enabling said fourth hinge pin to be biased upward by said fourth spring such that said first end of said fourth hinge pin ascends through said second one of said hinge pin holes on said lower side wall, when said second lever is moved to said open position, thereby enabling said right side of said bidirectional door to be opened or closed.

4. A computer housing comprising:

a case for protecting internal elements of a computer from an external impact;

a face which is attached to a front portion of said case, wherein said face comprises a plurality of detents respectively formed in each of four corners of an open area of said face; and a bidrectional door, which is installed in said open area of said face, said bidirectional door being opened/closed from both a left side and a right side of said door, wherein said bidirectional door comprises:

left, right, upper and lower side walls;

a plurality of catch pins elastically biased to extend through respective grooves in said upper and lower side walls and into corresponding ones of said plurality of detents;

a plurality of pockets respectively formed in each of four corners of said bidirectional door, wherein each said pocket has a curved side wall and upper and lower side walls, said upper side wall of each said pocket being disposed at one end of said pocket adjacent to a respective detent in said face when said bidirectional door is closed and said lower side wall being disposed at a distal end of each said pocket;

a plurality of pins horizontally extending from a rear portion of said bidirectional door and adjacent a perimeter of each of said pockets; and a plurality of fixing plates enclosing a respective one of said plurality of pockets, wherein each said fixing plate has a plurality of holes therein which engage corresponding ones of said plurality of pins extending from said rear portion of said bidirectional door to hold said catch pins in respective ones of said pockets.

5. The computer housing as set forth in claim 4, wherein said bidirectional door further comprises:

a plurality of fixed collars attached to respective ones of said catch pins; and a plurality of springs positioned over respective ones of said plurality of catch pins, wherein each said spring is positioned between a respective one of said collars and a respective one of said lower side walls of a respective one of said pockets.

6. The computer housing as set forth in claim 4, wherein said grooves are 'U' shaped.

7. A computer housing having a case for protecting internal elements of a computer, a face which is attached to a front portion of said case and a door positioned in an open area of said face, wherein said door has left, right, top and bottom side walls, said computer housing comprising:

first means, disposed adjacent said left side wall, enabling said door to be open and closed from a left side; and second means, disposed adjacent said right side wall, enabling said door to be opened and closed from a right side, wherein said first and second means each comprise:

a first spring holder, having a catch hole therein, attached to a rear side of said bidirectional door;

a first hinge pin hole in said top side wall;

a first tab extending horizontally from respective ones of said left and right side walls, said first tab having a second hinge pin hole therein aligned with and spaced a predetermined distance below said first hinge pin hole;

a second tab extending horizontally from respective ones of said left and right side walls, said second tab having a third hinge pin hole therein aligned with and spaced a predetermined distance below said second hinge pin hole;

a fourth hinge pin hole in said bottom side wall and aligned with said first hinge pin hole;

a third tab extending horizontally from respective ones of said left and right side walls, said third tab having a fifth hinge pin hole therein aligned with and spaced a predetermined distance above said fourth hinge pin hole;

a fourth tab extending horizontally from respective ones of said left and right side walls, said fourth tab having a sixth hinge pin hole therein aligned with and spaced a predetermined distance above said fifth hinge pin hole;

a lever positioned within an open space in respective ones of said left and right side walls and rotatably attached to said second and fourth tabs, said lever being rotatable between an open position and a closed position;

a cam attached to said lever;

a second spring holder, having a catch hole therein, attached to said cam;

a return spring, connected between said catch holes of said first and second spring holders, for biasing said lever towards said closed position;

a first hinge pin extending through said first, second and third hinge pin holes, said first hinge pin having a first end extending into a first catch groove formed in said face when said bidirectional door is closed, and a second end in contact with a first surface portion of said cam;

a second hinge pin extending through said fourth, fifth and sixth hinge pin holes, said second hinge pin having a first end extending into a second catch groove formed in said face when said bidirectional door is closed, and a second end in contact with a second surface portion of said cam;

a first stop pin diametrically extending through said first hinge pin;

a second stop pin diametrically extending through said second hinge pin;

a first spring positioned over said first hinge pin and in contact with said first stop pin and said first tab for biasing said first hinge pin downward; and a second spring positioned over said second hinge pin and in contact with said second stop pin and said third tab for biasing said second hinge pin upward.

8. The computer housing as set forth in claim 7, wherein said first and second surface portions of said cam are curved for enabling said first hinge pin to be biased downward by said first spring such that said first end of said first hinge pin descends through said first hinge pin hole, and for enabling said second hinge pin to be biased upward by said second spring such that said first end of said second hinge pin ascends through said fourth hinge pin hole, when said lever is moved from said closed position to said open position, thereby enabling said left side or said right side of said bidirectional door to be opened or closed.

* * * * *